United States Patent [19]

Noshi

[11] Patent Number: 4,564,123

[45] Date of Patent: Jan. 14, 1986

[54] MAGAZINE DRIVING DEVICE IN PAPER TUBE RELEASING APPARATUS

[75] Inventor: Shinji Noshi, Kyoto, Japan

[73] Assignee: Murata Kikai Kabushiki Kaisha, Japan

[21] Appl. No.: 536,526

[22] Filed: Sep. 28, 1983

[30] Foreign Application Priority Data

Oct. 1, 1982 [JP] Japan ..... 57-149343[U]

[51] Int. Cl.[4] ..... G07F 11/12

[52] U.S. Cl. ..... 221/11; 221/104

[58] Field of Search ..... 221/11, 104

[56] References Cited

U.S. PATENT DOCUMENTS 2,385,267 9/1945 Franz ..... 221/11

2,925,196 2/1960 Stoner ..... 221/11 X 3,576,275 4/1971 Bookout ..... 221/11

*Primary Examiner*—F. J. Bartuska

*Attorney, Agent, or Firm*—Spensley Horn Jubas & Lubitz

[57] ABSTRACT

A paper tube supply apparatus to an automatic winder. A paper tube releasing apparatus comprises a paper tube releasing section, a paper tube stock section, and a magazine driver section. The magazine driving device of the present invention includes a paper tube detecting mechanism for detecting the presence of absence of a paper tube in a releasing position and a clutch mechanism for allowing a rotational driving of the magazine to supply paper tubes stored in the successive cylinder.

8 Claims, 5 Drawing Figures

MAGAZINE DRIVING DEVICE IN PAPER TUBE RELEASING APPARATUS

BACKGROUND OF THE INVENTION

In an automatic winder having a number of winding units juxtaposed to one another, yarns drawn out from cops are wound on paper tubes. With respect to such paper tubes, a device has been known in which each winding unit is provided with a paper tube stock section to doff a copy from the stock section and supply it when the cop is made full.

Such a device is known, as example, by U.S. Pat. Nos. 4,066,218 and 3,323,680 and Japanese Patent Publication No. 1853/78. The known devices, however, are complicated in structure, because each unit requires a stock section and a take out device. Further, when the device is used in an automatic doffing apparatus where the device is run as a doffer along the winding units, the device may impede the running operation of the apparatus. In addition, paper tubes are manually supplied to the paper tube stock sections of the units, thus necessitating a cumbersome operation.

Accordingly, in some devices, each winding unit is not provided with a paper tube stock section. Instead, paper tubes are received in carriages equipped with the aforementioned doffers, so that the received paper tubes may be released and supplied simultaneously with doffing operation. A problem with the devices of this kind is that the number of paper tubes which can be received in the carriages varies considerably, depending on the shape of paper tube. For example, a paper tube or wooden tube used as a cheese is cylindrical and hence has no directivity. Therefore, a number of paper tubes can be received in a given space and so once they have been received, an automatic doffing can be effected for a long time.

On the other hand, when each paper tube is conic and used as a cone, the paper tubes to be received in a doffing carriage must be aligned and separated. Further, only several tubes can be received. Accordingly, frequent supply of paper tubes to the carriage is required. Thus, means for effectively stocking and transporting a number of conic paper tubes to be replenished have been sought for.

SUMMARY OF THE INVENTION

The present invention relates to a paper tube supply apparatus to an automatic winder and, more particularly, relates to a paper tube releasing apparatus comprising a paper tube releasing section, a paper tube stock section, and a magazine diver section.

An object of the present invention is to provide a magazine driving device in such a paper tube releasing apparatus to move the succeeding cylinder holding paper tubes when the paper tubes supplied from the preceding cylinder in the paper tube stock section to the paper tube releasing section have been carried away successively and discretly, whereby automatically supplying the paper tubes held in cylinders to the paper tube releasing section.

The apparatus including the paper tube releasing section and the paper tube stock section is disposed at one position on one side of an automatic winder. A number of tapered paper tubes are piled on top of one another into a towering form. Such towers are then stored as a lot in one of the cylinders in the paper tube stock section. After the paper tubes which have been supplied from one of the cylinders to the paper tube releasing section are separated and carried away, the succeeding cylinder in the stock section is moved, whereby automatically supplying the paper tubes in the cylinder to the paper tube releasing section.

The device of the present invention comprises a paper tube detecting mechanism for detecting the presence or absence of a paper tube in a releasing position and a clutch mechanism for allowing a rotational driving of the magazine to supply paper tubes stored in the successive cylinder to the releasing section when no paper is present in the releasing position.

DETAILED DESCRIPTION OF THE INVENTION

Figure 1:
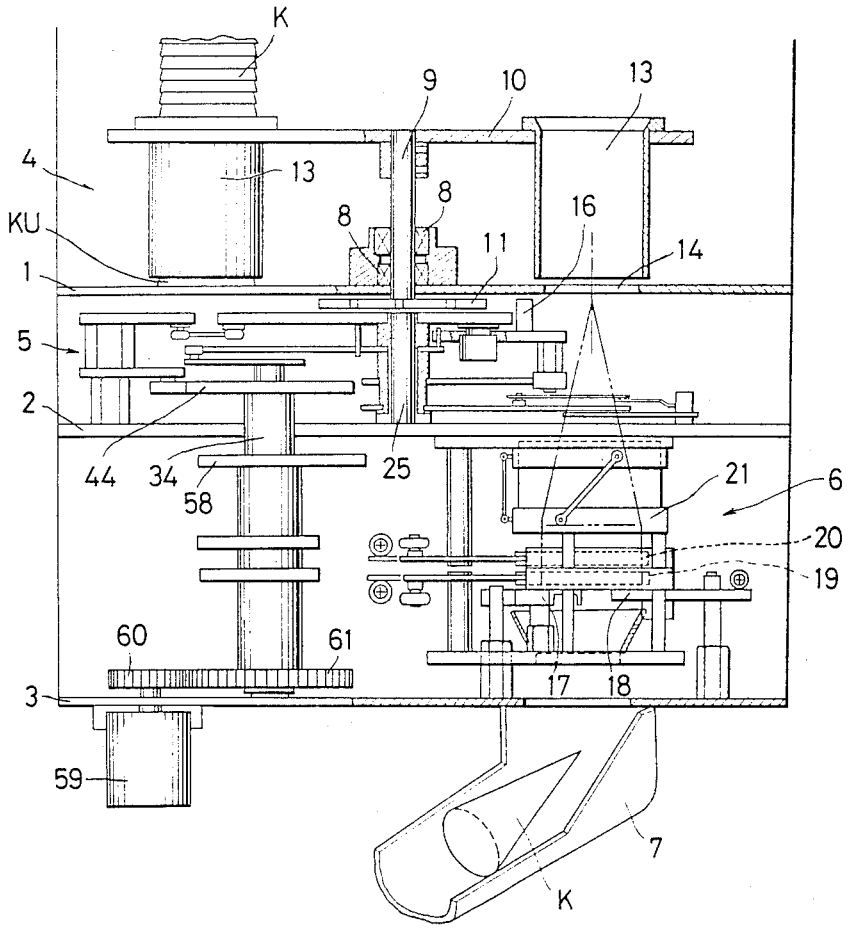
FIG. 1 is a schematic front elevation showing the construction of a paper tube releasing device according to the present invention.

One embodiment of the present invention is hereinafter described with reference to the drawings. To facilitate the understanding of the invention, a releasing device is first described with reference to FIG. 1. The releasing device is separated into a paper tube stock section 4, a magazine driver section 5, and a releasing section 6 for releasing a paper tube from stacked tapered paper tubes, by partition plates 1, 2, 3. The single paper tube K released is transported to a conveying device (not shown) through a chute 7.

Figure 2:
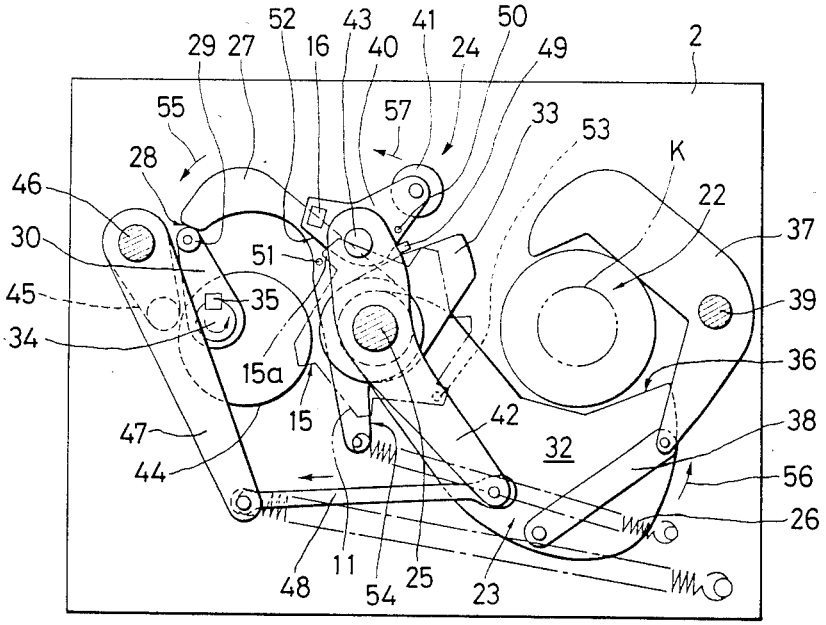
FIG. 2 is a plan view showing the construction of the magazine driver section shown in FIG. 1.

The paper tube stock section 4 is comprised of a shaft 9, a magazine 10 secured to the upper end of the shaft 9, and a latch wheel 11 secured to the lower end of the shaft 9 and peripherally provided with a plurality of latches. The shaft 9 extends through the partition plate 1 and is rotatably supported by a bearing 8. In the magazine 10, bottomless cylinders 13 are inserted and supported in holes formed in a disk with equal pitch. In this specific example, six cylinders 13 are supported with a pitch of 60 degrees to constitute the magazine. The partition plate 1 is provided with one hole 14 just below one of the cylinders 13 to allow paper tubes to fall therethrough toward the underlying releasing device. The latch wheel 11 is peripherally formed with six latches 15 as shown in FIG. 2, so that latch pins 16 (described later) may engage with these latches to provide an intermittent rotation.

A number of conic paper tubes K are heaped on top of one another into a towering form in each bottomless cylinder 13 such that the bottom of each conic tube is placed at the lowest position. The lowermost paper tube KU abuts on the partition plate 1. As the shaft 9 is rotated intermittently, the paper tubes are caused to slide over the partition plate 1 and are intermittently shifted.

The paper tube releasing section 6 is comprised of split, movable stops 17 and 18 which support the paper tubes K, a first chuck mechanism 19 holding only the lowermost paper tube, a second chuck mechanism 20 holding the paper tube next to the lowermost paper tube, and a drawer mechanism 21 for lowering the first chuck mechanism while angularly moving the whole first mechanism through a given angle. Thus, the lowermost paper tube gripped by the first chuck mechanism is separated from the paper tube next to the lowermost paper tube. Then, by unlocking the first chuck mechanism, the gripped paper tube falls onto the chute 7.

Figure 3:
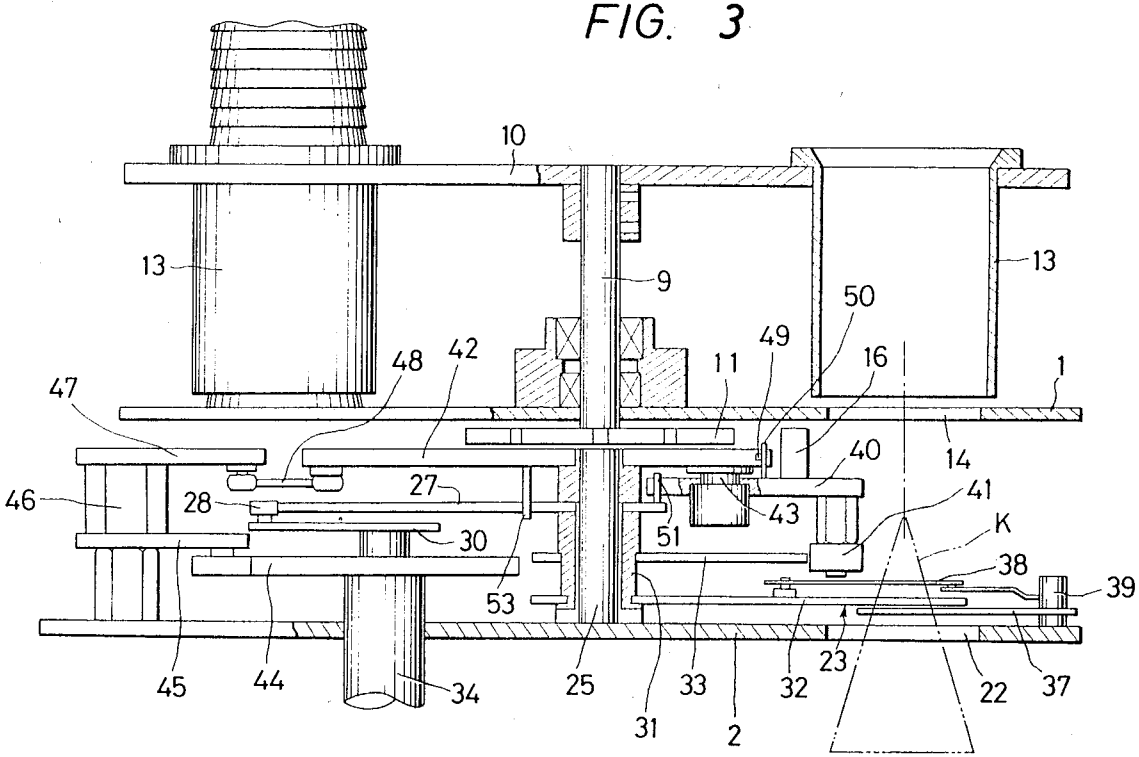
FIG. 3 is a front elevation partially in section of the construction shown in FIG. 2.

The present invention is concerned with the magazine driving device in the paper tube stock section of the paper tube releasing device. As shown in FIGS. 2 and 3, the magazine driving device comprises a mechanism 23 for detecting the presence or absence of the paper tube K in a hole 22 formed in the partition plate 2 to allow paper tubes to pass therethrough, and a clutch mechanism 24 for permitting a rotational driving force to be transmitted to the magazine driving latch wheel only when no paper tube is present in the hole.

The mechanism 23 for detecting paper tubes consists of a feeler 27, a rotary lever 30, a paper tube detecting lever 32, and a latch pressing cam 33 rotatable with the lever 32. The feeler 27 is biased in the counterclockwise direction as viewed in FIG. 2 about a fixed shaft 25 by a spring 26. The lever 30 supports a cam roller 29 which engages with, and disengages from, a cam surface 28 on one end of the feeler 27. The lever 32 is secured to the feeler 27 by a boss 31 (FIG. 3) such that the lever 32 moves together with the feeler.

When a cam shaft 34 turns once in the counterclockwise direction as viewed in FIG. 2, the lever 30 secured to the shaft 34 by a key 35 is also rotated once. As soon as the rotation of the lever is initiated, the spring 26 rotates the feeler 27 about the shaft 25. This causes the lever 32 to rotate, so that the inner fringe 36 of the lever 32 rotates and passes over the hole 22 through which paper tubes pass.

An auxiliary lever 37 is connected to the lever 32 via a coupling rod 38 and rotates about a fixed shaft 39. When a paper tube is present in the hole, the auxiliary lever acts to embrace the paper tube and engage the opposite sides of the outer periphery of the tube for preventing the tube from being out of position and for maintaining it in a certain posture.

Accordingly, if paper tube K exists and extends through the hole 22 as shown in FIG. 3, for example, the detecting lever 32 abuts on the tube K with the result that the range of angles within which the lever is allowed to rotate is limited. If the range of angles exceeds a predetermined value, that is, when no paper tube exists, the latch pressing cam 33 which rotates with the detecting lever 32 will strike against a roller 41 in a clutch lever 40 (described later) and move it.

The clutch mechanism 24 is comprised of a rocking lever 42 which rocks about the fixed shaft 25 within a certain range of angles, a clutch lever 40 angularly movable about a shaft 43 depending from one end of the lever 42, a roller 41 depending from the underside of the lever 40, and the aforementioned latch pin 16 projecting upright from the upper side of the lever.

The rocking lever 42 is connected to a lever 47 via a rod 48. The lever 47 is secured by a shaft 46 to a cam lever 45 abutting on a cam 44 on the cam shaft 34 such that the lever 45 rocks together with the lever 47. Thus, the lever 42 can be driven.

Protruding from a side fringe of the rocking lever 42 is a stop 49 which is capable of engaging with a pin 50 on the clutch lever 40. Protruding upright from the feeler 27 is a stop 51 capable of engaging with a side fringe 52 of the lever 40. These stops act to ensure an origin position for the lever 40, which is free to rock between the stops 49 and 51. Protruding from the underside of the lever 42 is a pin 53 capable of engaging with a side fringe 54 of the feeler 27. The pin 53 serves to press the detecting lever 32 and the auxiliary lever 37, which surround the paper tube when the tube is in the hole 22, in such a direction that these levers are unlocked. Then, the lowermost paper tube is caused to fall into the chute. Thereafter, the pin causes one paper tube gripped by the upper second chuck to fall plumb down onto the stop levers 17 and 18 shown in FIG. 1.

Thus, when no paper tube is present in the hole 22 shown in FIGS. 2 and 3, one rotation of the cam shaft 34 releases the rotary lever 30 and causes the spring 26 to rotate the feeler 27 in the direction indicated by an arrow 55. The feeler then rotates the detecting lever 32 and the latch pressing cam 33. Absence of a paper tube allows the detecting lever to rotate through the maximum angle in the direction indicated by an arrow 56. The cam 33 then strikes with the roller 41, rotating the clutch lever 40 about the shaft 43 in the direction indicated by an arrow 57. As a result, the latch pin 16 on the lever 40 comes into engagement with a latch **15*a* on the latch wheel 11 secured to the revolving shaft 9 of the magazine 10**.

Figure 4:
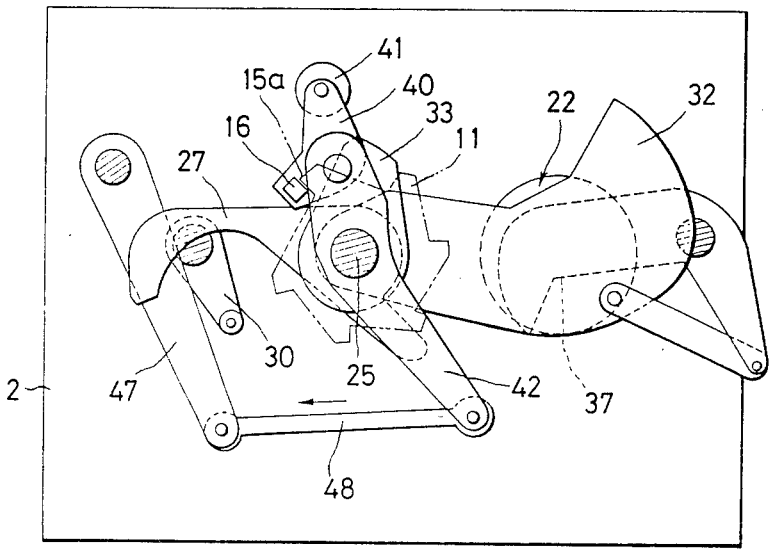
FIG. 4 is a plan view of the magazine driver section of FIG. 2 for illustrating the operation when no paper tube is present.

Subsequently, the magazine cam 44 rotates the rocking lever 42 about the shaft 25 clockwise via the levers 45, 47 and the rod 48, thus revolving the lever 40 round the shaft 25. Since the latch wheel 11 engages with the latch pin 16, the wheel 11 is rotated clockwise by one pitch, whereby turning the magazine 10 shown in FIG. 3 by one pitch. Then, the cylinder 13 receiving a number of paper tubes piled in the form of a tower is moved to the position located above the hole 14 in the partition plate 1. The result is that one of the paper tubes in the bottomless cylinder 13 falls onto the detecting lever 32 and placed thereon temporarily (FIG. 4).

Figure 5:
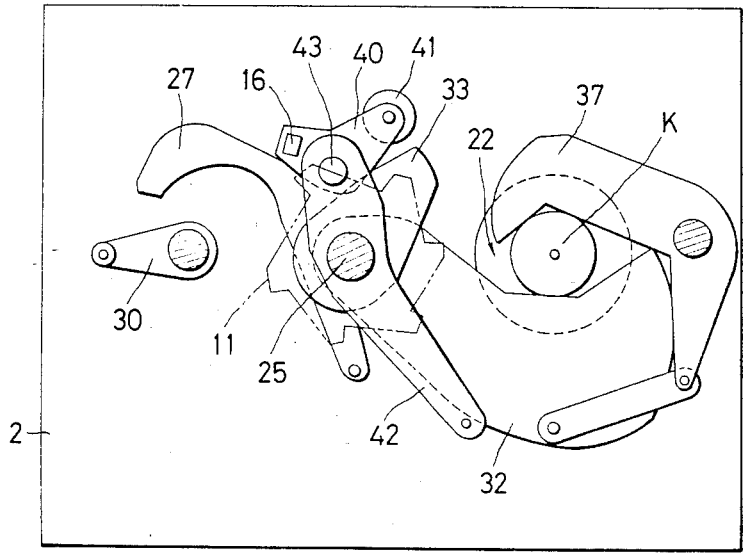
FIG. 5 is a plan view of the magazine driver section of FIG. 2 for illustrating the operation when a paper tube is present.

When the paper tube K is present in the hole 22, the tube K prevents the detecting lever 32 from rotating, so that the latch pressing cam 33 will not rotate through an angle sufficient to strike with the roller 41 of the clutch lever 40. Therefore, the latch pin 16 does not engage with the latch wheel 11. Hence, even if the rocking lever 42 rocks, neither the wheel 11 nor the magazine 10 will rotate (FIG. 5).

The operation of the first chuck 19, the second chuck 20, drawer driving cam 58, the magazine cam 44, and the feeler 27 is now described. An electric motor 59 shown in FIG. 1 is first driven in accordance with a paper tube supply command, and the cam shaft 34 is rotated once via gears 60 and 61. Then, the feeler 27 is rotated in the direction indicated by an arrow 55 to effect the aforementioned paper tube detection. Thereafter, the cam 44 for rotating the magazine 10 angularly moves the rocking lever 42 through a certain angle. The rotation of the magazine is controlled depending on the presence or absence of a paper tube in the hole 22.

At the same time, the second chuck 20 in the releasing section 6 is locked to grip the paper tube next to the lowermost paper tube. After completing the gripping operation, the first chuck 33 grips the lowermost paper tube. Then, the drawer driving cam lowers the movable cylinder 21 while angularly moving it through a certain angle to separate the paper tube gripped by the first chuck 19 from the upper paper tubes. Subsequently, the first chuck 19 is unlocked, thus allowing the separated paper tube to fall onto the chute, followed by an elevation of the movable cylinder 21. Then, the second chuck 20 is unlocked, permitting the remaining paper tubes to fall onto the stops 17 and 18 of FIG. 1.

When no paper tube is present in the hole 22 of FIG. 2, one rotation of the cam shaft 34 causes the releasing section to run idle, angularly moving the magazine 10 by one pitch. Then, new paper tubes are introduced into the hole 22 and temporarily placed on the detecting lever 32 shown in FIG. 4 as described previously. Then, the movable cylinder 21 in the drawer mechanism is moved upward to its original position. Thereafter, the lever 30 restores the feeler 27 of FIG. 2 to its original position, releasing the detecting levers 32 and 37. As a result, the paper tubes on the levers are allowed to fall onto the underlying stops 17 and 18 and are placed thereon, thus making preparations for the next releasing operation.

As described in detail hereinbefore, the magazine driving device of the present invention is comprised of the paper tube detecting mechanism 23 for detecting the presence or absence of the paper tube K in the hole 22 through which paper tubes pass, and the clutch mechanism 24 for allowing a rotational driving force to be transmitted to the latch wheel for driving the magazine only when no paper tube is present in the hole. The absence of paper tube allows the detecting lever 32 of the paper tube detecting mechanism 23 to rotate through a large angle. This causes the latch pressing cam 33 to strike and move the roller 41 of the clutch mechanism 24, rotating the clutch lever 40 about the shaft 43, so that the latch pin 16 comes into engagement with the latch 15*a* of the latch wheel 11 for driving the magazine. Concurrently, the lever 40 is revolved round the shaft 25, thus allowing the rotational driving force to be transmitted to the wheel 11. A number of tapered paper tubes K are piled on top of one another in each cylinder 13 secured to the magazine 10 such that each tube K is disposed in non-inverted manner. The lowermost paper tube KU is placed so as to abut on the partition plate 1, and is slided to the position located above the hole 14 in the partition plate 1 as the magazine 10 is rotated in accordance with a paper tube supply command. Then, the paper tubes in the cylinder 13 are temporarily placed on the detecting lever 32. Subsequently, the paper tubes are allowed to fall onto the paper tube releasing section 6 through the hole 22 for feeding purposes. Accordingly, by holding the towering paper tubes in the magazine, these paper tubes are released one by one from the paper tube stock section through the paper tube releasing section in accordance with a paper tube command from the winder. Then, the tubes are automatically fed to the winder by means of a conveyor.

If 50 paper tubes piled on top of one another can be placed in 6 cylinders in the novel paper tube magazine, then the releasing device can contain 300 paper tubes. If the doffing apparatus can doff 60 full cops per hour, an automatic running can be continued for 5 hours. Further, by increasing the paper tube receiving capacity of the releasing device, that is, by increasing either the number of the cylinders holding paper tubes in the magazine or the number of paper tubes piled, the continuous automatic running for automatic doffing and paper tube supply can be further extended.

When the presence or absence of the paper tube K is detected using only the detecting lever 32, the tube is pressed from one side and hence might be out of position. Accordingly, it is quite preferred that the auxiliary lever 37 interlocking with the detecting lever 32 as shown in FIG. 2 be provided to grip the tube from opposite sides.

What is claimed is:

1. A magazine driving device for supplying at least one tube in a tube releasing apparatus of the type having a tube stock section, a tube releasing section and a magazine driver section, the magazine driving device comprising:

(a) a magazine driving latch wheel;

(b) a clutch mechanism for transmitting a rotational force to the latch wheel when no tube is present in the magazine driver section, the clutch mechanism comprising:

(i) a first shaft;

(ii) a first clutch member rotatably coupled to the shaft so that the shaft is the axis of rotation of the first clutch member;

(iii) a second clutch member rotatably coupled to the first clutch member;

(iv) a latch pin coupled to the second clutch member for engaging the latch wheel; and (c) a tube detecting mechanism for detecting the presence or absence of a tube in the magazine driver section and engaging the clutch mechanism when no tube is present, the tube detecting mechanism comprising:

(i) a first detector member having a cam surface, the first detector member being rotatably coupled to the shaft;

(ii) force means for applying a rotational force to the first detector member;

(iii) a rotating member periodically engagable with the cam surface of the first detector member, wherein the rotating member is disposed to oppose, during periods of engagement, the rotation of the first detector member which is induced by the force means;

(iv) a second detector member for detecting by contact the presence of a tube, the second detector member being coupled to the first detector member so that the first and the second detector members rotate in unison around the shaft; and (v) a third detector member for engaging the clutch mechanism with the latch wheel, wherein the third detector member is coupled to the second detector member so that the first, the second and the third detector members rotate in unison around the shaft and so that when the rotation of the second detector member is not stopped by contact with the tube, the third detector member drives the second clutch member in a direction which engages the latch pin with the latch wheel.

2. a magazine driving device as in claim 1, further comprising:

a second shaft approximately parallel to the first shaft;

a fourth detector member rotatably coupled to the second shaft; and a coupling member coupling the second detector member to the forth detector member so that the second detector member and the forth detector member move in unison toward and away from approximately opposite sides of the tube.

3. A magazine driving device for supplying at least one tube in a tube releasing apparatus of the type having a tube stock section, a tube releasing section and a magazine driver section, the magazine driving device comprising:

(a) a magazine driving member;

(b) a clutch mechanism for transmitting a rotational force to the magazine driving member when no tube is present in the magazine driver section;

(c) a tube detecting mechanism for detecting the presence or absence of a tube in the magazine driver section and engaging the clutch mechanism when no tube is present, the tube detecting mechanism comprising:

(i) a first shaft;

(ii) a first detector member having a cam surface, the first detector member being rotatably coupled to the shaft;

(iii) force means for applying a rotational force to the first detector member;

(iv) a rotating member periodically engagable with the cam surface of the first detector member, wherein the rotating member is disposed to oppose, during periods of engagement, the rotation of the first detector means which is induced by the force means;

(v) a second detector member for detecting by contact the presence of a tube, the second detector member being coupled to the first detector member so that the first and the second detector members rotate in unison around the shaft;

(vi) a third detector member for engaging the clutch mechanism with the magazine driving member, wherein the third detector member is coupled to the second detector member so that the first, the second and the third detector members rotate in unison around the shaft and so that when the rotation of the second detector member is not stopped by contact with the tube, the third detector member contacts the clutch mechanism so that the clutch mechanism is enabled to transmit a rotational force to the magazine driving member; and (d) a second shaft approximately parallel to the first shaft;

(e) a fourth detector member rotatably coupled to the second shaft; and (f) a coupling member coupling the second detector member to the fourth detector member so that the second detector member and the fourth detector member move in unison toward and away from approximately opposite sides of the tube.

4. A magazine driving device as in claim 3, wherein the magazine driving member is a latch wheel.

5. A magazine driving device of the type used in conjunction with a tube releasing apparatus having a sectionalized tube storage magazine, a tube releasing section and a magazine driving device for rotating the storage magazine and thereby enabling each section of the magazine to supply at least one tube to the tube releasing section after the tube supply in the previous magazine section is exhausted, the magazine driving device comprising:

(a) a rotatable latch wheel coupled to the storage magazine and having an axis of rotation;

(b) a clutch mechanism for transmitting a rotational force to the latch wheel, the clutch mechanism comprising:

(i) a rotatable first clutch member having the same axis of rotation as the rotatable latch wheel;

(ii) a second clutch member rotatably coupled to a distal portion of the first clutch member;

(iii) a latch pin for engaging the latch wheel, the latch pin being coupled to a distal portion of the second clutch member; and (c) tube detecting means associated with the clutch mechanism for detecting the presence or absence of a tube and rotating the second clutch member to engage the latch pin with the latch wheel when no tube is detected; and (d) rotating means for rotating the first clutch member so that, when the latch pin is engaged with the latch wheel, the latch pin rotates the latch wheel.

6. A magazine driving device as in claim 5, wherein the tube detecting means comprises:

a first rotatable detector member for detecting the presence of the tube by rotating into contact with the tube, wherein the first detector member has an axis of rotation;

a second detector member coupled to the first detector member so that the first and the second detector members rotate in unison and wherein the second detector member is disposed so that when the rotation of the first detector member is not stopped by contact with the tube, the second detector member drives the second clutch member so that the second clutch member rotates the latch pin into engagement with the latch wheel.

7. A magazine driving device as in claim 6, further comprising:

a rotatable third detector member disposed so that the third detector member can rotate into contact with the tube on approximately the opposite side of the tube from the first detector member; and a forth detector member coupling the first and the third detector members so that the first and the third detector members rotate in unison toward and away from the tube.

8. A magazine driving device as in claim 6, wherein the latch wheel, the first clutch member and the first detector member all have the same axis of rotation.

* * * * *